US007108220B2

(12) United States Patent
Nagel et al.

(10) Patent No.: US 7,108,220 B2
(45) Date of Patent: Sep. 19, 2006

(54) ADHESIVE TAPE

(75) Inventors: Christoph Nagel, Hamburg (DE); Thomas Gassner, Heidgraben (DE)

(73) Assignee: tesa AG, Hamburg (DE)

( * ) Notice: Subject to any disclaimer, the term of this patent is extended or adjusted under 35 U.S.C. 154(b) by 0 days.

(21) Appl. No.: 10/076,819

(22) Filed: Feb. 15, 2002

(65) Prior Publication Data

US 2002/0172790 A1 Nov. 21, 2002

(30) Foreign Application Priority Data

May 17, 2001 (DE) ..... 101 23 981

(51) Int. Cl.
*B65H 19/18* (2006.01)
*B32B 7/12* (2006.01)

(52) U.S. Cl. ..... 242/556.1; 242/556; 428/40.1; 428/343; 428/354; 156/304.1

(58) Field of Classification Search ..... 428/40.1, 428/343, 57, 354; 156/504, 304.1; 242/556.1, 242/556
See application file for complete search history.

(56) References Cited

U.S. PATENT DOCUMENTS 5,212,002 A 5/1993 Madrzak et al. ..... 428/40
5,323,981 A * 6/1994 Dionne ..... 242/58.5
5,901,919 A 5/1999 Wienberg ..... 242/556.1
6,595,461 B1 * 7/2003 Storbeck et al. ..... 242/556.1
6,637,697 B1 10/2003 Wienberg ..... 242/556.1
2001/0003617 A1 * 6/2001 Storbeck et al. ..... 428/355 AC

FOREIGN PATENT DOCUMENTS

DE 0 970 904 A1 1/2000
JP 2000-038559 * 2/2000

OTHER PUBLICATIONS

European Search Report, dated Dec. 12, 2003, for EP 02 00 9196.

* cited by examiner

*Primary Examiner*—Harold Pyon
*Assistant Examiner*—Patricia L. Nordmeyer
(74) *Attorney, Agent, or Firm*—Norris McLaughlin & Marcus PA

(57) ABSTRACT

An adhesive tape (1) for flying reel change, having a) a carrier (2), on whose upper side a self-adhesive compound (3) is arranged, and b) on whose underside a cleavable system (6A) is arranged, having a paper carrier (7) which, on one side, is adhesively bonded by means of a self-adhesive compound (8) to the underside of the carrier (2), and which on the other side has a self-adhesive compound (9), wherein c) at a distance (W) of 3–50 mm from the cleavable system (6A), a further cleavable system (6B) is arranged, again having a paper carrier (7) which, on one side, is adhesively bonded by means of a self-adhesive compound (8) to the underside of the carrier (2) and which, on the other side, has a self-adhesive compound (9).

21 Claims, 1 Drawing Sheet

ADHESIVE TAPE

Figure 1:
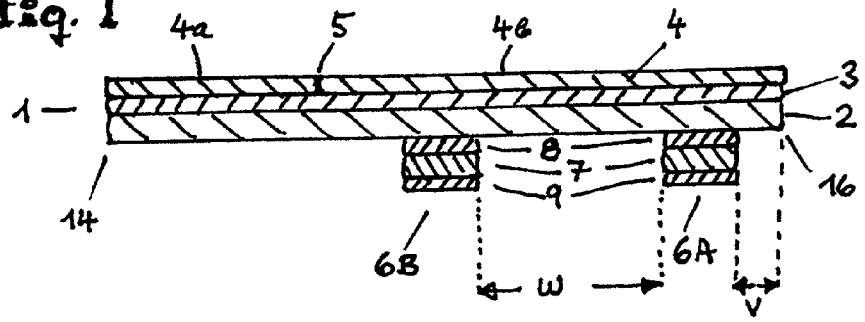

The invention relates to an adhesive tape for flying reel change and to a splice method using such an adhesive tape, especially in paper converting machines, printing machines and the like.

Different adhesive tapes and splice geometries are known for the flying reel change.

These methods have the disadvantage of complicated preparation, which entails considerable possible errors, or, as a result of using tabs, open adhesive points run through the further processing process.

For the non-adhesive covering of otherwise open adhesive regions, DE 196 32 689 A2 discloses an adhesive tape for dynamic loading during the splice method, whose paper carrier cleaves and covers the adhesive compounds with its residues.

Also of this type is an adhesive tape according to DE 199 02 179 A1, likewise for a splice method. On its non-adhesive rear side, this adhesive tape bears a double-sided adhesive tape, which has a paper carrier which is easy to cleave, cleaves during the splice method and covers the respective adhesives. In this case, in order to avoid breaks during the flying reel change, the adhesive tape laminated on is arranged to be set in with a paper carrier made of cleavable paper, specifically at a certain distance (V) from the longitudinal edge of the adhesive tape.

A further variant is described in DE 198 30 674. Here, an adhesive tape with 2 cleavable strips is described, these being placed on the two longitudinal edges of the adhesive tape.

In practice, even these adhesive tapes exhibit disadvantages, primarily because a flying reel change does not succeed but instead ends as a break, without any evident reason for this.

It was an object of the invention to provide a remedy here.

This object is achieved by an adhesive tape (1) for flying reel change, having:

a) a carrier (2), on whose upper side a self-adhesive compound (3) is arranged, and b) on whose underside a cleavable system (6A) is arranged, having a paper carrier (7) which, on one side, is adhesively bonded by means of a self-adhesive compound (8) to the underside of the carrier (2), and which on the other side has a self-adhesive compound (9), wherein c) at a distance (W) of 3–50 mm from the cleavable system (6A), a further cleavable system (6B) is arranged, again having a paper carrier (7) which, on one side, is adhesively bonded by means of a self-adhesive compound (8) to the underside of the carrier (2) and which, on the other side, has a self adhesive compound (9).

In another embodiment, the distance (W) is 25–40 mm, especially 35–40 mm.

In another embodiment, the adhesive tape comprises cleavable systems (6A and 6B) which consist of the same material and therefore exhibit the same cleavage forces. The adhesive tape may also comprise cleavable systems (6A and 6B) which consist of different material and therefore exhibit different cleavage forces.

In another embodiment, the carrier (2) is wider than both cleavable systems (6A and 6B) and the distance (W) between these taken together, and the cleavable system (6A) is arranged to be set in the region of the leading edge (16) of the adhesive tape (1) by 0.5–15 mm, especially 1–7 mm, quite particularly 1.5–3.5 mm (distance V).

In another embodiment, the carrier (2) comprising the self adhesive compound (3) is at least 1.5 times as wide as the overall width of the two cleavable systems (6A and 6B) taken together.

In another embodiment, the carrier (2) is a tear-resistant paper or film carrier.

In another embodiment, the self-adhesive compounds (8, 9, 3) are based on acrylates (water-insoluble or especially water-soluble), natural rubber and/or synthetic rubber and their dispersions.

In another embodiment, the self-adhesive compound (3) is provided with a covering (4) which, in particular, is provided with a perforation or a slit (5) in the longitudinal direction (parallel to the longitudinal edges (14,16).

In another embodiment, the cleavage strength of the cleavable systems (6A and 6B) is 20 to 70 cN/cm, in particular 22 to 60 cN/cm.

In another embodiment, the cleavable systems (6A and 6B) each have a width of 3–50 mm, especially 6–40 mm.

In another embodiment, the adhesive tape has a width of 70 to 400 mm, especially 100–200 mm.

Another object of the invention is achieved by a splice method, in which the uppermost web (10) of a reel has an adhesive tape (1) partly adhesively bonded behind it, while the underside of the adhesive tape is bonded to the web (11) lying underneath it and therefore secures the uppermost web (10), if appropriate, firstly only part (4*a*) of the covering (4) possibly located on the self-adhesive compound (3) having been pulled off, so that the part of the self-adhesive compound needed for the splice method is still covered by a covering and, in this state, the reel has no free adhesive surface, the remaining covering (4*b*) which may still be present then being removed for the final preparation of the splice method, the new reel equipped in this way then being placed alongside an almost completely unwound old reel to be replaced and being accelerated to the same rotational speed as the latter, then being pressed against the old web (12), the exposed self-adhesive compound (3) of the adhesive tape (1) bonding adhesively to the old web (12) at substantially equal speeds of the webs (10 and 12), while at the same time the paper carrier (7) made of cleavable material cleaves and, with its residues (7*a*, 7*b*), covers both self-adhesive compounds (8, 9) with which it is coated so that they are non-adhesive.

In another embodiment of the splice method, the adhesive tape (1) is adhesively bonded at right angles to the running web (10, 12).

It is precisely in the case of large paper reels with large circumferences that crease-free application of these products appears to be possible only with difficulty.

In the case of the variant described in DE 198 30 674, it is easily possible for loose adhesive bonding to occur in the upper paper layer in the center between the two cleavable strips, which threatens the fault-free performance of the splice. Especially in the case of adhesive tape widths of more than 50 mm, this problem occurs to a greater extent.

The variant described in DE 199 02 179 A1 results in difficulties during the reel preparation of the type in which the adhesive tape stands out from the paper reel at the rear end, which makes crease-free bonding of the upper paper layer more difficult. A creased bond in the uppermost paper layer always entails the risk of breaks in the paper converting or printing machine.

By means of the adhesive tape according to the invention, the application is simplified considerably, and therefore a higher splice reliability is achieved, because of the fact that the two cleavable systems are positioned at a distance of at least 3 mm but of at most 50 mm from each other.

The two systems, bonded to the paper layer below the uppermost paper layer of the reel to be spliced, fix the uppermost paper layer in such a way that crease-free bonding is possible without difficulty.

A further possible reason for breaks is damage to the front one of the two cleavable paper carriers during or after the bonding to the paper reel. The cleavable system that leads in the machine running direction is particularly important for the functionality of the adhesive tape. If the cleavable paper carrier is damaged here during the bonding to the paper reel or during the storage of the bonded paper reel, cleavage of the cleavable carrier even occurs before the actual splice operation, and there is the possibility that the uppermost paper layer of the new reel will become detached and unwind. Even in the event of only low cleavage of the cleavable paper, it is possible for the uppermost paper layer to turn over to some extent, and therefore for a break to occur. This is particularly critical when cleavable systems with low cleavage strengths are being processed.

During the storage of a bonded paper reel, tensile forces may occur on the uppermost paper layer as a result of temperature differences or humidity differences.

The invention provides a remedy here, as a result of a novel arrangement of the cleavable systems and as a result of the possibility of using cleavable systems with different cleavage forces. Trials have shown that the cleavage forces do not add up, instead that it is always only the system with the higher cleavage force which results in the maximum cleavage strength for the overall product.

This results in the possibility of producing a product with two systems which can be cleaved to different extents and which may easily be bonded, which permits crease-free bonding of the uppermost paper layer, which can be bonded without damage to the first cleavable system in the machine running direction, since the front cleavable system preferably has higher cleavage strengths, and which can be stored better, since the absorption of tensile stresses caused by the different cleavable systems may be increased.

The cleavable systems advantageously have a considerably lower cleavage resistance than a paper carrier, which has to absorb tensile forces.

The following papers or paper composite systems, for example, are considered as cleavable systems, especially as cleavable papers:

Diverse cleavable paper systems are considered as cleavable paper, such as

- Duplex papers (papers laminated together in a defined manner, the cleavage operation proceeds extremely homogeneously and no stress peaks are produced, for example as a result of inhomogeneous compaction. These papers are used for the production of wall coverings and filters.
- Easily cleavable paper systems.
- Highly compacted papers glued together in a defined manner (→paper with a high cleavage strength). The gluing can be carried out, for example, with starch, starch-containing derivatives, wallcovering adhesives based on methylcellulose (Methylan®, Henkel KGaA, Düsseldorf), but also based on polyvinyl alcohol derivatives.
- A cleavable system according to DE 198 41 609 A1 can also be used. The cleavage forces are determined here in particular by the size of the bonding points.
- The advantageous insetting of the cleavable material or the distance from the longitudinal edge should be about 0.5–15 mm, in particular 1–7 mm and, quite particularly, 1.5 mm–3.5 mm.
- The width of each of the cleavable systems is preferably 3–50 mm, especially 6–40 mm.

All basic types of contact adhesive compound are considered as self-adhesive compounds, especially

- acrylates (water-soluble and water-insoluble)
- natural rubber compounds, synthetic rubber compounds and their dispersions
- The distance of the cleavable systems from one another is 3–50 mm. Preference is given to distances of 25–45 mm, quite particularly distances of 30–40 mm.

The splice method, here the adhesive bonding to the splice tape, can especially be carried out in such a way that the adhesive tape is bonded at right angles to the running web.

The drawings show a schematic representation of an adhesive tape according to the invention and its use and are therefore intended to explain the invention by way of example.

In relation to cleavage strength and its measurement, reference is made to DE 199 02 179 A1, also in relation to the materials that can be used, in particular papers and adhesive compounds.

Also suitable are configurations as are described in DE 196 28 317 A1, but also according to DE 196 32 689. Reference is therefore expressly made to these documents. However, a configuration according to DE 199 02 179 A1 is particularly preferred.

Figure 2:
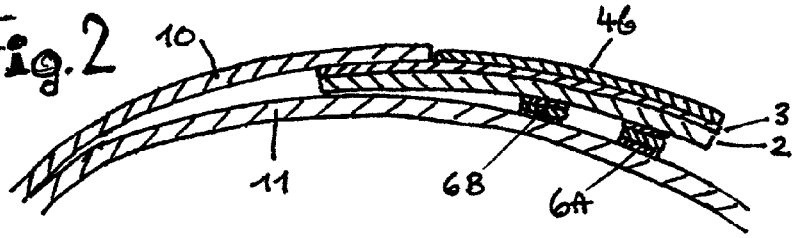
Figure 3:
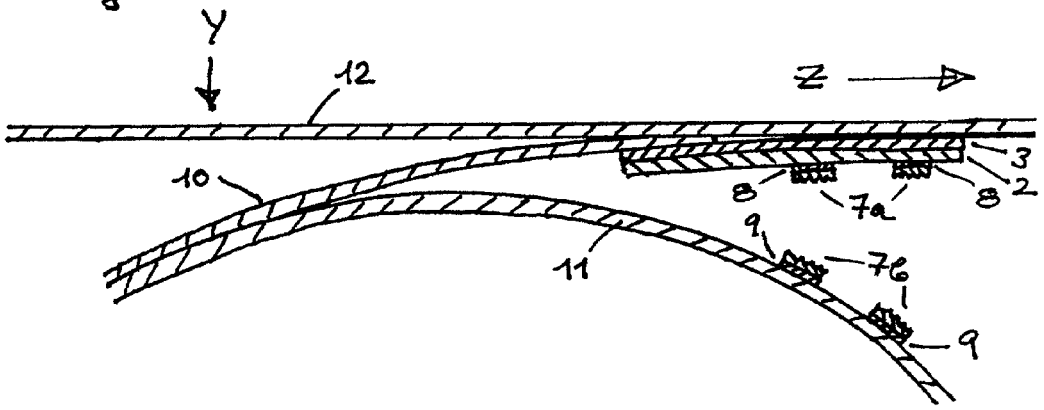

In the following text, the invention is to be explained in more detail using an exemplary embodiment, without thereby wishing to restrict it unnecessarily. In the figures:

FIG. 1 shows a lateral, schematic view of an adhesive tape according to the invention, FIG. 2 shows a lateral, schematic view of an adhesive tape according to FIG. 1, bonded onto a paper reel and (apart from release paper 4*b*) ready for a flying reel change, and FIG. 3 shows a view according to FIG. 2, but after the flying reel change has been carried out.

In detail, FIG. 1 shows an adhesive tape 1 having a carrier 2 made of slightly creped paper, coated on one side with a water-soluble self-adhesive compound 3. The overall thickness of the carrier 2 with the self-adhesive compound 3 is 0.088 mm, the width 150 mm, on the market as tesakrepp 51447 from Beiersdorf, Germany. The self-adhesive compound 3 is covered with a siliconized release paper (covering) 4, which is provided at a distance of 30 mm from the left-hand edge (trailing edge 14) with a slit 5, so that first of all the left-hand part 4*a* of the release paper 4 can be removed, and then the right-hand part 4*b*. At the right-hand end (leading edge 16) of the adhesive tape 1, two strips of a double-sided adhesive tape 6A and 6B are bonded underneath, comprising a paper carrier 7 made of cleavable paper, coated on both sides with water-soluble self-adhesive compound 8 and 9, respectively. The strips 6A and 6B each have a width of 9 mm. The strip 6A is arranged at a distance V of 3 mm from the leading edge 16 of the adhesive tape 1. The distance W between the strips 6A and 6B is 38 mm. If necessary, the self-adhesive compound 9 bears a release paper but this is omitted when the product is rolled up into a roll, since then the self-adhesive compound 9 comes to lie on the upper side of the release paper 4.

FIG. 2 shows how such an adhesive tape 1 is bonded behind a paper web 10 (the uppermost paper web on a paper reel), to be specific by the left-hand part after the release paper 4*a* has been pulled off this part. The adhesive tape 1 is bonded, with the exposed self-adhesive compounds 9 (6A and 6B) onto the paper web 11 of the paper reel lying under the paper web 10. The right-hand part 4*b* of the release paper 4 is then pulled off as well, so that the paper reel equipped in this way is ready for a flying reel change.

The self-adhesive compound 3 is now open (in the region which was covered by the right-hand part 4*b* of the release paper 4) and, for the flying change, represents the contact surface to the outgoing web 12. The contact surface has a width of 120 mm and extends over the entire width of the paper reel.

The (new) paper reel equipped in this way is brought alongside the unwound (old) paper reel, to which the new is to be attached. The new paper reel is accelerated to a rotational speed which corresponds to the speed of the outgoing web. Once both speeds are sufficiently synchronized, the change can be completed; the web 12 running out in the direction of the arrow Z is brought by means of a pressure shaft into contact with the circumference of the new reel, the self-adhesive compound 3 is adhesively bonded to the outgoing paper web 12 in accordance with FIG. 3. Momentarily after the bonding contact, the easily cleavable paper carriers 7 cleave in such a way that one part 7*a* remains on the adhesive tape 1 and there covers the self-adhesive compound 8, while the other part 7*b* remains on the self-adhesive compound 9 which bonds to the paper web 11. Therefore, both self-adhesive compounds 8 and 9 are neutralized to a certain extent, no longer form an adhesive bond and therefore do not interfere either in the further process in the paper processing machine. After the new reel has been bonded onto the outgoing paper web 12, the latter is knocked off or severed in the region of the arrow Y. The reel change has therefore been completed.

The invention claimed is:

1. An adhesive tape for a flying reel splice, comprising:

a) a carrier material comprising an upper side and a lower side;

b) first and second cleavable systems, comprising first and second paper carriers, respectively, which are adhesively bonded on one side to the lower side of the carrier material, wherein the first and second cleavable systems are separated by a distance W of 3–50 mm; and c) a self-adhesive compound applied on the upper side of the carrier material and on the side of the first and second paper carriers opposite said one side, wherein the carrier material is wider than a combined width of the first cleavable system, the second cleavable system and the distance W, and the first cleavable system is arranged in a region of a leading edge of the adhesive tape at a distance V of 0.5–15 mm, and the second cleavable system is arranged in a middle portion of the adhesive tape.

2. The adhesive tape as claimed in claim 1, wherein the distance W is 25–40 mm.

3. The adhesive tape as claimed in claim 2, wherein the distance W is 35–40 mm.

4. The adhesive tape as claimed in claim 1, wherein the first and second cleavable systems comprise the same material and exhibit the same cleavage forces.

5. The adhesive tape as claimed in claim 1, wherein the first and second cleavable systems comprise different material and exhibit different cleavage forces.

6. The adhesive tape as claimed in claim 1, wherein the carrier material is at least 1.5 times as wide as a combined width of the first and second cleavable systems.

7. The adhesive tape as claimed in claim 1, wherein the carrier material is a tear-resistant paper or film carrier.

8. The adhesive tape as claimed in claim 1, wherein the self-adhesive compound is based on acrylates, natural rubber and/or synthetic rubber and their dispersions.

9. The adhesive tape as claimed in claim 8, wherein the acrylates are water insoluble or water soluble.

10. The adhesive tape as claimed in claim 1, wherein the self adhesive compound is provided with a covering.

11. The adhesive tape as claimed in claim 10, wherein the covering is provided with a perforation or a slit in a longitudinal direction which is parallel to the longitudinal edges of the adhesive tape.

12. The adhesive tape as claimed in claim 1, wherein the first and second cleavable systems have a cleavage strength of 20 to 70 cN/cm.

13. The adhesive tape as claimed in claim 12, wherein the cleavage strength is 22–60 cN/cm.

14. The adhesive tape as claimed in claim 1, wherein each cleavable system has a width of 3–50 mm.

15. The adhesive tape as claimed in claim 14, wherein the width is 6–40 mm.

16. The adhesive tape as claimed in claim 1, which has a width of 70 to 400 mm.

17. The adhesive tape as claimed in claim 16, wherein the width is 100–200 mm.

18. The adhesive tape as claimed in claim 1, wherein the distance V is 1–7 mm.

19. The adhesive tape as claimed in claim 1, wherein the distance V is 1.5–3.5 mm.

20. A splicing method comprising the following steps:

a) providing an adhesive tape according to claim 1;

b) providing a new reel of paper having a top web of paper and another web of paper beneath said top web of paper;

c) adhering part of the self-adhesive compound on the front side of the paper carrier of said adhesive tape to an underside of said top web of paper;

d) adhering a first and second cleavable systems of said adhesive tape to a topside of said web of paper beneath said top web of paper;

e) placing said new reel of paper beside an unwinding reel of paper;

f) accelerating said new reel of paper to the same speed as said unwinding reel of paper;

g) pressing said new reel of paper against said unwinding reel of paper so that:

i) an unadhered part of the self-adhesive compound on the front side of the paper carrier of said adhesive tape becomes adhered to said unwinding reel of paper, thereby to form a splice between said new reel of paper and said unwinding reel of paper; and ii) a cleavable paper cleaves in a such way that upon cleavage remains of said cleavable paper cover both self-adhesive compounds on said cleavable paper and render both self-adhesive compounds outwardly non-adhesive.

21. The splicing method as claimed in claim 20, wherein the adhesive tape is adhesively bonded at right angles to the unwinding reel of paper and the new reel of paper.

* * * * *